US008214966B2

(12) United States Patent
Steffen et al.

(10) Patent No.: US 8,214,966 B2
(45) Date of Patent: Jul. 10, 2012

(54) VACUUM CLEANER NOZZLE HEIGHT INDICATOR

(75) Inventors: Cennert Steffen, Bloomington, IL (US); David Brendley, Atlanta, IL (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 1052 days.

(21) Appl. No.: 12/143,922

(22) Filed: Jun. 23, 2008

(65) Prior Publication Data

US 2008/0313846 A1 Dec. 25, 2008

(51) Int. Cl.
*A47L 5/34* (2006.01)

(52) U.S. Cl. ..... 15/339; 15/354

(58) Field of Classification Search ..... 15/339, 15/354; *A47L 5/34, 7/00, 9/00*
See application file for complete search history.

(56) References Cited

U.S. PATENT DOCUMENTS

| | | | |
|---|---|---|---|
| 2,107,016 | A | 2/1938 | Snyder |
| 2,823,412 | A | 2/1958 | Kirby |
| 3,381,652 | A | 5/1968 | Schaefer et al. |
| 3,683,448 | A | 8/1972 | Lagerstrom et al. |
| 4,199,838 | A | 4/1980 | Simonsson |
| 4,392,271 | A | 7/1983 | Sepke |
| 4,437,205 | A | 3/1984 | Koland |
| 4,467,495 | A | 8/1984 | Fish et al. |
| 4,481,692 | A | 11/1984 | Kurz |
| 4,614,003 | A | 9/1986 | Martin |
| 4,791,700 | A | 12/1988 | Bigley et al. |
| 4,955,103 | A | 9/1990 | Scott et al. |
| 5,042,109 | A | 8/1991 | Stephens |
| 5,207,498 | A | 5/1993 | Lawrence et al. |
| 5,467,501 | A | 11/1995 | Sepke |
| 5,561,346 | A | 10/1996 | Byrne |
| 6,253,414 | B1 | 7/2001 | Bradd et al. |
| 6,289,552 | B1 | 9/2001 | McCormick |
| 6,490,755 | B2 | 12/2002 | Paterson et al. |
| 6,497,002 | B2 | 12/2002 | Paterson et al. |
| 6,499,183 | B1 | 12/2002 | Paterson et al. |
| 6,553,599 | B2 | 4/2003 | Paterson et al. |
| 6,637,067 | B2 | 10/2003 | Paterson et al. |
| 6,672,735 | B2 | 1/2004 | Dilger et al. |
| 7,143,467 | B2 | 12/2006 | Seith |
| 2002/0038488 | A1 | 4/2002 | Paterson et al. |
| 2002/0038489 | A1 | 4/2002 | Paterson et al. |
| 2002/0038490 | A1 | 4/2002 | Paterson et al. |
| 2003/0037402 | A1 | 2/2003 | Paterson et al. |
| 2004/0216266 | A1 | 11/2004 | Conrad |
| 2005/0115014 | A1 | 6/2005 | Worwag |
| 2005/0273968 | A1 | 12/2005 | Seith |
| 2006/0021184 | A1 | 2/2006 | Hawkins et al. |
| 2006/0076035 | A1 | 4/2006 | McGee et al. |
| 2006/0096057 | A1 | 5/2006 | Chatfield |

*Primary Examiner* — David Redding
(74) *Attorney, Agent, or Firm* — RatnerPrestia

(57) ABSTRACT

A nozzle height indicator for a vacuum cleaner. The nozzle height indicator has a height display adapted to be viewed by a user, a light source adapted to emit light, and a blocking member. The blocking member is adapted to be positioned in a first position in which it allows the light to illuminate the height display and a second position in which it substantially prevents the light from illuminating at least a portion of the height display. The blocking member may indicate the height of an associated vacuum cleaner inlet nozzle relative to a surface being cleaned. A vacuum cleaner inlet nozzle is also provided.

16 Claims, 9 Drawing Sheets

VACUUM CLEANER NOZZLE HEIGHT INDICATOR

FIELD OF THE INVENTION

The present invention relates generally to vacuum cleaners and, more specifically, to a nozzle height indicator having a height display for indicating the height of an associated vacuum cleaner inlet nozzle relative to the surface being cleaned.

BACKGROUND OF THE INVENTION

Various vacuum cleaners having height adjustment devices have been produced in the prior art. In many cases, the height adjustment device includes a carriage to raise and lower the front portion of a vacuum nozzle housing to regulate the height of a brushroll located inside the nozzle housing relative to the surface being cleaned. Such devices are usually user-actuated by a foot pedal that engages a camming mechanism, but it is also known to use electronically or hand-operated devices. In some cases, the height adjustment device also includes a display that indicates the nozzle height position to the operator. An example of such a device is U.S. Patent Publication No. 2006/0021184, which is incorporated herein by reference.

It is also known to provide vacuum cleaners with illuminated displays. Usually, such illuminated displays include a display indicator and a light source that emits light onto the display indicator. Depending on the function of the display, the display indicator informs the user about the vacuum's operating condition, for example, whether the vacuum cleaner is in operation, the dust bag is full, or what power output the vacuum cleaner is producing.

Although illuminated displays and height adjustment devices are known in the art, such devices are not typically used together because it can be expensive or technically difficult to provide an illuminated nozzle height display. For example, U.S. Patent Publication No. 2006/0021184 illustrates a nozzle height adjustment device that has an LED display associated with it. While this device is useful for providing a simple to understand and brightly lit display to the user, it requires control circuitry and/or sensors to correlate the illuminated display reading with the actual height of the inlet nozzle with accuracy. As such, there still remains a need to provide a simplified and economical light indicating device to illustrate the nozzle height position of a vacuum cleaner.

SUMMARY OF THE INVENTION

In one exemplary aspect, the present invention may provide a nozzle height indicator for a vacuum cleaner. The nozzle height indicator has a height display adapted to be viewed by a user, a light source adapted to emit light, and a blocking member. The blocking member is adapted to be positioned in a first position in which it allows the light to illuminate the height display and a second position in which it substantially prevents the light from illuminating at least a portion of the height display.

In another exemplary aspect, the present invention may provide a nozzle height indicator for a vacuum cleaner. The nozzle height indicator has a height display comprising a plurality of height indicators, a light source adapted to emit light, and a blocking member adapted to be positioned in a plurality of positions to selectively allow the light from the light source to illuminate one or more of the light indicators, thereby indicating the height of an associated vacuum cleaner inlet nozzle relative to a surface being cleaned.

In another exemplary aspect, the present invention may provide a vacuum cleaner inlet nozzle. The inlet nozzle has a nozzle housing, an inlet positioned on the lower face of the nozzle housing and adapted to face a surface to be cleaned, and a carriage moveably attached to the nozzle housing. Movement of the carriage adjusts the distance between the inlet and the surface to be cleaned. Also included is a carriage height adjuster adapted to selectively position at least a portion of the carriage at two or more predetermined distances from the lower face of the nozzle housing. The inlet nozzle also has a height display adapted to be viewed by a user, at least one light source adapted to emit light, and a blocking member adapted to be positioned in a first position in which it allows light from the light source to illuminate the height display and a second position in which it substantially prevents light from the light source from illuminating at least a portion of the height display. The height display shows the position of the carriage relative to the lower face of the nozzle housing.

Further embodiments and variations are described herein and encompassed within the scope of the claims.

BRIEF DESCRIPTION OF THE DRAWINGS

Various exemplary aspects of the invention will be readily understood from the following detailed description and the accompanying drawings, which are exemplary only, and not intended to limit the invention.

DETAILED DESCRIPTION OF THE PREFERRED EMBODIMENTS

Figure 1A:
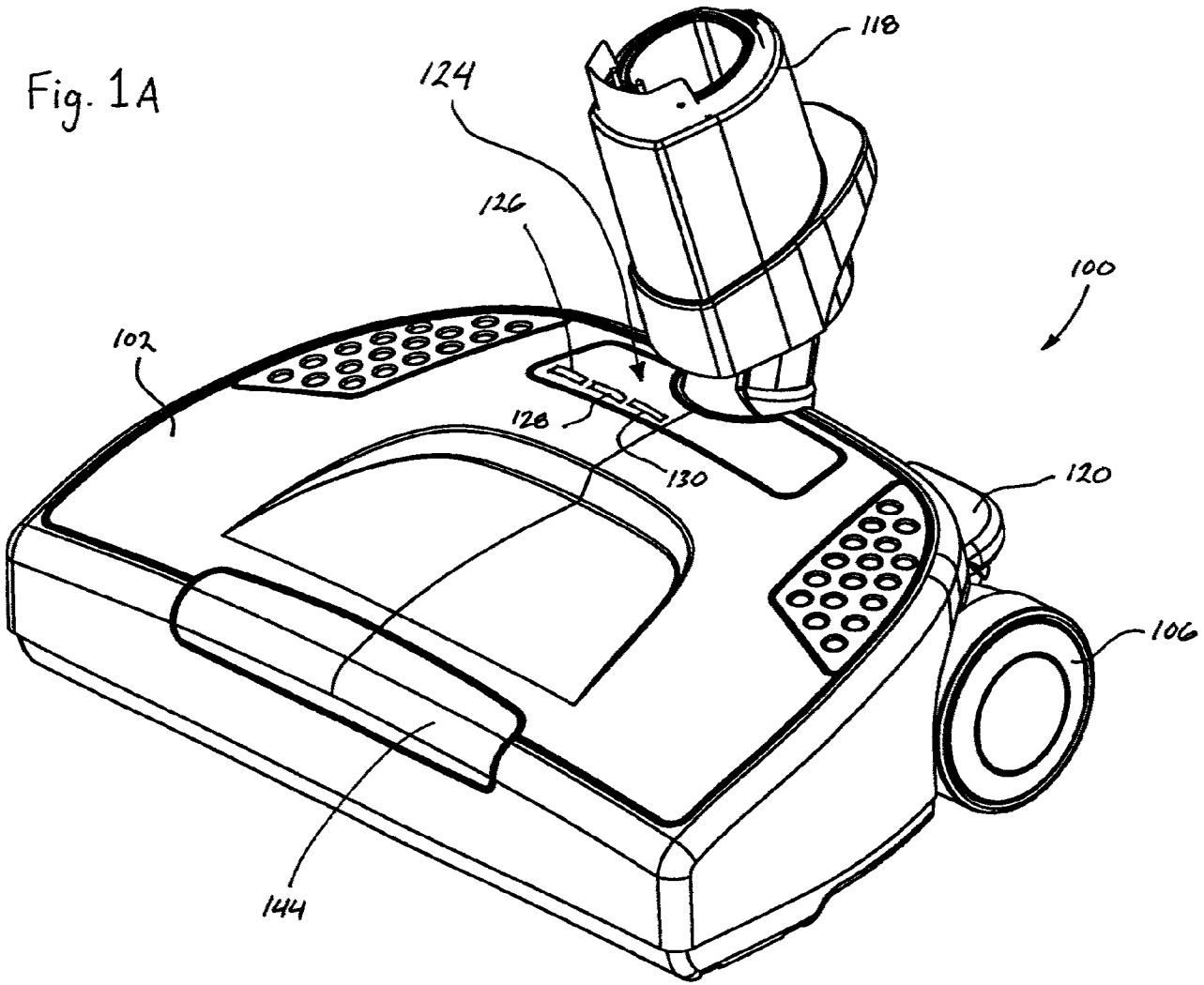
FIG. 1A is a front perspective view of a nozzle housing for a vacuum cleaner according to an exemplary embodiment of the invention.
Figure 1B:
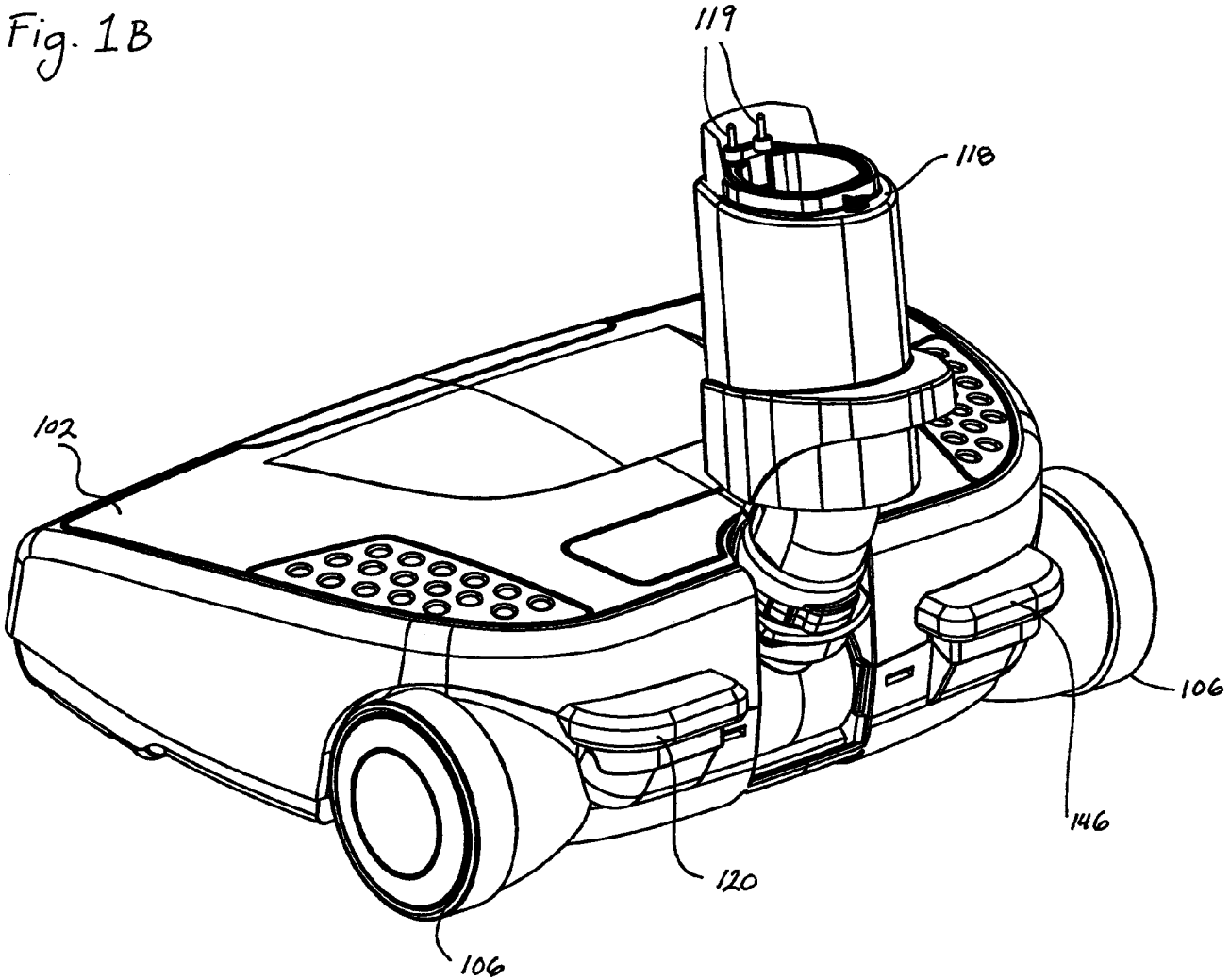
FIG. 1B is a rear perspective view of the nozzle housing of FIG. 1A.

The present invention generally provides a nozzle height indicator for a vacuum cleaner. Embodiments of the invention may be used with any type of cleaning device, such as upright vacuums, canister vacuums, or central vacuum systems. Non-limiting examples of such devices are shown in U.S. Publication No. 2006/0021184 and U.S. Pat. Nos. 6,502,277 and 7,163,568, which are incorporated herein by reference. In the exemplary embodiments, the nozzle height indicator shows the position of the vacuum cleaner nozzle inlet relative to the surface being cleaned, but it may be used to provide a visual indication of other types of movable devices. For example, it may be used to indicate the height of a brushroll that moves up and down within a vacuum cleaner housing, or the height of a wheel carriage that moves up and down. Other variations of an indicator of the invention can be used to indicate the position of a vacuum cleaner air valve, or other moving parts. These and further uses will be understood by persons of ordinary skill in the art in view of the present disclosure.

Referring to FIGS. 1A-3, an exemplary vacuum nozzle generally includes a nozzle housing 100 having a top cover 102 that is removably attached to a base frame 104. The nozzle housing 100 is supported for movement over a surface being cleaned at the rear by one or more rear wheels 106, and at the front by one or more front wheels 108. The front wheels 108 (or other support devices, such as skids or a plate) are attached to a carriage assembly 110 that is adapted to move the front wheels 108 vertically with respect to the nozzle housing 100.

The vacuum nozzle may be attached to any suitable cleaning device. In the exemplary embodiments shown herein, the cleaning device comprises a conventional powerhead attachment for a canister vacuum. A hollow vacuum wand, handle or hose (not shown) can be attached to the nozzle housing 100 by a stem 118 that connects the inlet opening 112 to a vacuum source and connects the brushroll motor and other electronics by electrical contacts 119 to an electrical source, as known in the art. The stem 118 may be pivotally mounted to the nozzle housing 100, and provided with a latch 120 that may be used to lock the stem 118 in the upright (or other) position. A latch spring 122 may be provided to bias the latch 120 in the locking position. The associated vacuum cleaner can use a bag, cyclone, or any other kind of dirt collection system. Alternatively, the nozzle housing 100 may be the base of an upright vacuum cleaner. In another embodiment, the vacuum nozzle housing can be connected to a central vacuum system using an auxiliary hose or other tools. These and other features of cleaning devices are understood by those of ordinary skill in the art, and any variations thereof may be used with the present invention.

The nozzle housing 100 includes a downwardly-facing inlet opening 112 (FIG. 1C), which may be shaped in the form of a brushroll chamber 114. In the shown embodiment, the brushroll chamber is formed as part of the base frame 104, but it instead may be formed by the top cover 102 or by other parts. A brushroll 302 or other agitator or agitators may be provided in the brushroll chamber 114. The exemplary brushroll 302 is mounted in the housing 100 by a removable metal or plastic base plate 116 that captures in the brushroll 302 in place, as known in the art, but other agitator attachment configurations may be used instead. The brushroll 302 may comprise any type or combination of agitating members 304, such as helical rows of bristles, as known in the art. The agitating members 304 extend through the inlet opening 112 to contact the surface being cleaned. The brushroll 302 may be rotated by any type of motor such as an air turbine, an electric motor that also drives a vacuum fan, wheels that contact the surface being cleaned, or a separate brushroll motor 306, as known in the art. A belt 308 or other device may be used to operatively connect the brushroll motor 306 to the brushroll 302, and seals 310 may be provided to seal the belt 308 from the brushroll chamber 114. One or more covers 312 may be provided over the brushroll motor 306 to insulate it from the nozzle housing 100 and hold it in place. While the embodiments shown herein include a brushroll, this is not necessary of all embodiments of the invention. For example, the brushroll may be removed entirely, or replaced by other types of agitator.

Figure 1C:
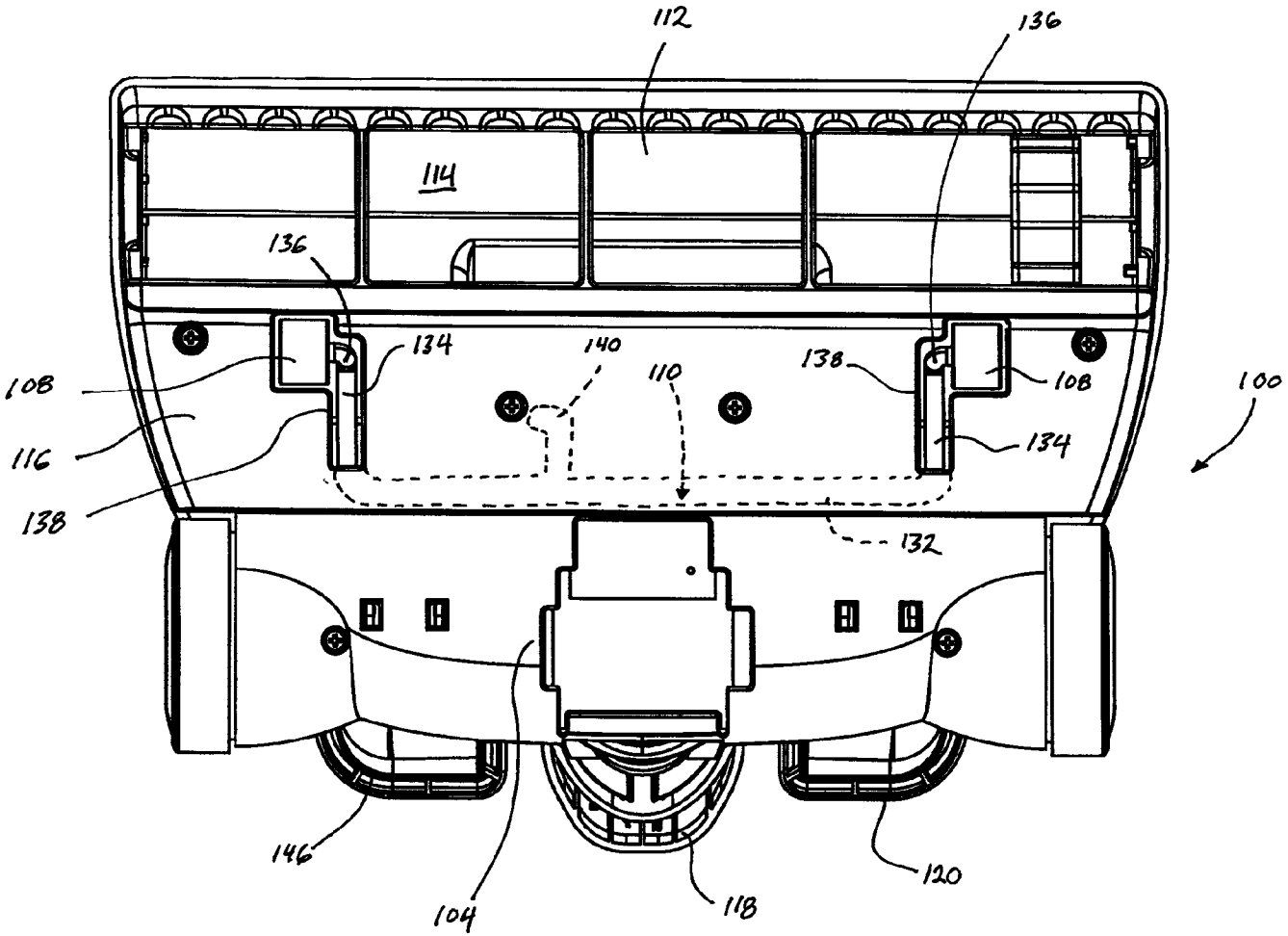
FIG. 1C is a bottom plan view of the nozzle housing of FIG. 1A.
Figure 3:
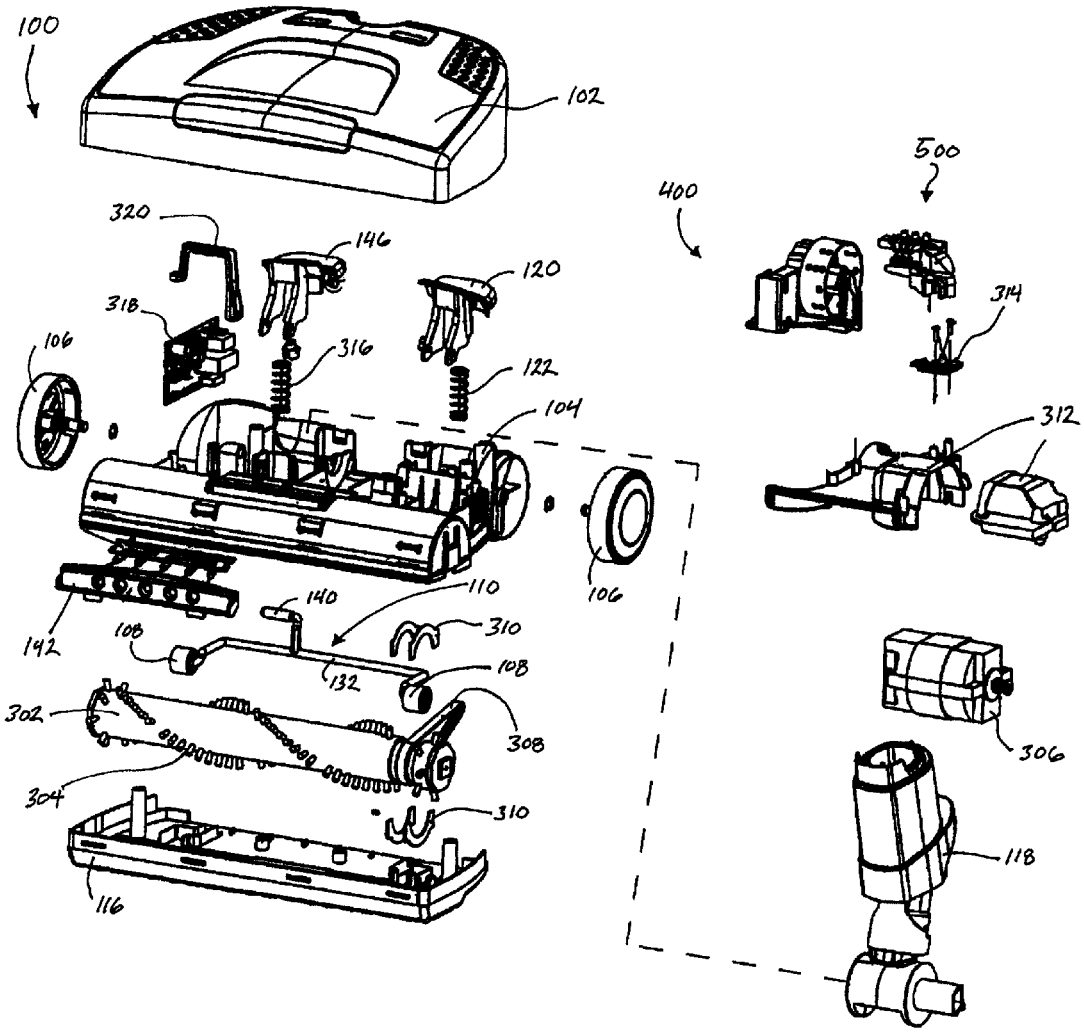
FIG. 3 is an exploded view of the nozzle housing of FIG. 1A.

As noted above, the carriage assembly 110 is used to adjust the height of the front wheels 108 relative to the nozzle housing 100, which has the result of moving the brushroll 302 and inlet opening 112 vertically with respect to the surface being cleaned. Such adjustments may be desirable to regulate how deeply the brushroll 302 penetrates carpet surfaces, and may also enable the brushroll 302 to be lifted out of contact with surfaces that may not benefit from using a brushroll, such as hardwood, linoleum or tiled floors. Where no brushroll is used, such height adjustment still may be provided to regulate the inflow of air into the inlet opening 112. Referring to FIGS. 1C and 3, the carriage assembly 110 of the exemplary embodiment comprises a generally U-shaped structure having a laterally extending crosspiece 132 and a leg 134 at each end of the crosspiece 132. The legs 134 are bent to form wheel mounts 136. The front wheels 108 may be rotatably attached to the wheel mounts 136 and held in place by a snap, pushnut or other fastener, as known in the art. The crosspiece 132 may be mounted by any suitable method, such as by being snapped into grooves (not shown) in the base frame 104 and is captured in place by the base plate 116. When so installed, the crosspiece 132 operates as a pivot about which the carriage assembly can rotate. The legs 134 may extend through slots 138 in the base plate 116, as best shown in FIG. 1C, to allow them with an unobstructed travel path.

Figure 6:
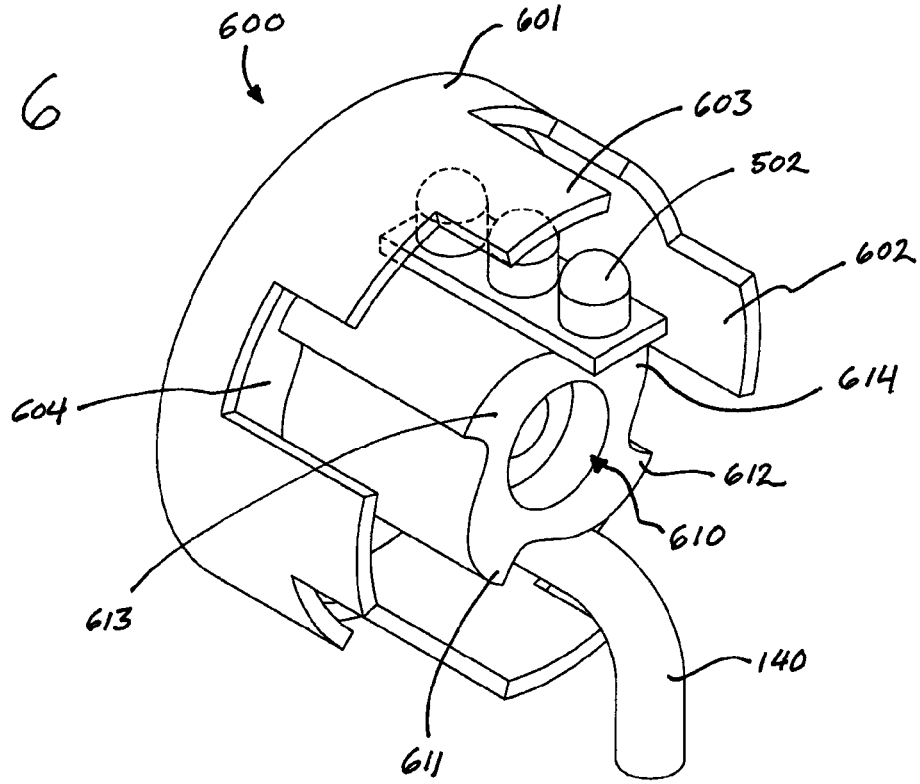
FIG. 6 is a perspective view of an alternative exemplary embodiment of a blocking member and carriage height adjustment cam.

A height adjusting mechanism is provided to pivot the carriage assembly 110 and thereby move the front wheels 108 relative to the nozzle housing 100. For example, the height adjusting mechanism may press on the legs 134 or wheel mounts 136, or even the wheels 108 themselves. In the shown exemplary embodiment, the height adjustment mechanism operates by pressing on a lever arm 140 that extends from the crosspiece 132 (or a leg 134) through the base frame 104 and into the nozzle housing 100. An exemplary height adjustment mechanism 400 can operate using a height adjustment cam 610, which is shown in FIG. 6, or any other suitable device. In this embodiment, the bent end of the lever arm 140 is engaged and moved by the carriage height adjustment cam 610 as the cam 610 rotates, and thereby the carriage assembly 110 is pivotally moved between a lower elevated position in which the wheels 108 are pivoted to be relatively close to the inlet and a maximum elevated position in which the wheels 108 are pivoted to be relatively distant from the inlet. A spring (not shown) may be provided in the housing or elsewhere to bias the carriage assembly 110 into the lowermost position (i.e., with the carriage pulled against the nozzle housing 100) to prevent the carriage assembly 110 from moving freely when the nozzle housing 100 is lifted above the ground.

While the foregoing exemplary carriage assembly 110 is used to adjust the position of the front wheels 108, it may instead adjust the position of the base plate 116, the rear wheels 106, the brushroll 302, or other parts. Furthermore, the carriage assembly 110 may operate by linear, sliding or other non-pivoting movement, if desired. Such modifications will be understood by persons of ordinary skill in the art in view of the present disclosure.

In an exemplary embodiment, the top cover 102 may include a height display 124 that is used to indicate the brushroll and/or nozzle height position. In the shown embodiment, the height display 124 has a first height indicator 126, a second height indicator 128, and a third height indicator 130. The height indicators 126, 128 and 130 preferably comprise or are used in conjunction with one or more transparent windows 202 (FIG. 2) through the top cover 102. The windows 202 instead may be translucent or comprise simple openings. The windows 202 may be formed from plastic, glass, or any other material that allows light to be visible to the user through the display indicators 126, 128, and 130. In an exemplary embodiment, the first height indicator 126 is adapted to be illuminated when the nozzle housing 100 is at its lowest operating height (i.e. when the front wheels 108 are closest to the nozzle housing 100); the first and second indicators 126, 128 are adapted to be illuminated when the nozzle housing 100 is at an intermediate elevated height; and the first, second and third indicators 130 are adapted to be illuminated when the nozzle housing 100 is at its highest elevated height (i.e., when the front wheels 108 are furthest from the nozzle housing 100). Alternatively, only the second indicator 128 may be illuminated when the nozzle housing 100 is at an intermediate elevated height and/or only the third indicator 130 may be illuminated when the nozzle housing 100 is at its highest elevation. It will be understood that the height display is not limited to three indicators, and may have any number of display indicators that are operatively associated with a plurality of different elevated positions. Furthermore, the display indicators may be located elsewhere on the nozzle housing 100, such as on the side or front of the top cover 102, or may be located elsewhere on a vacuum cleaner, such as on the upright housing of an upright vacuum cleaner. The display indicators also may be adapted to project light onto the surface being cleaned to indicate the operating position to the user.

Figure 2:
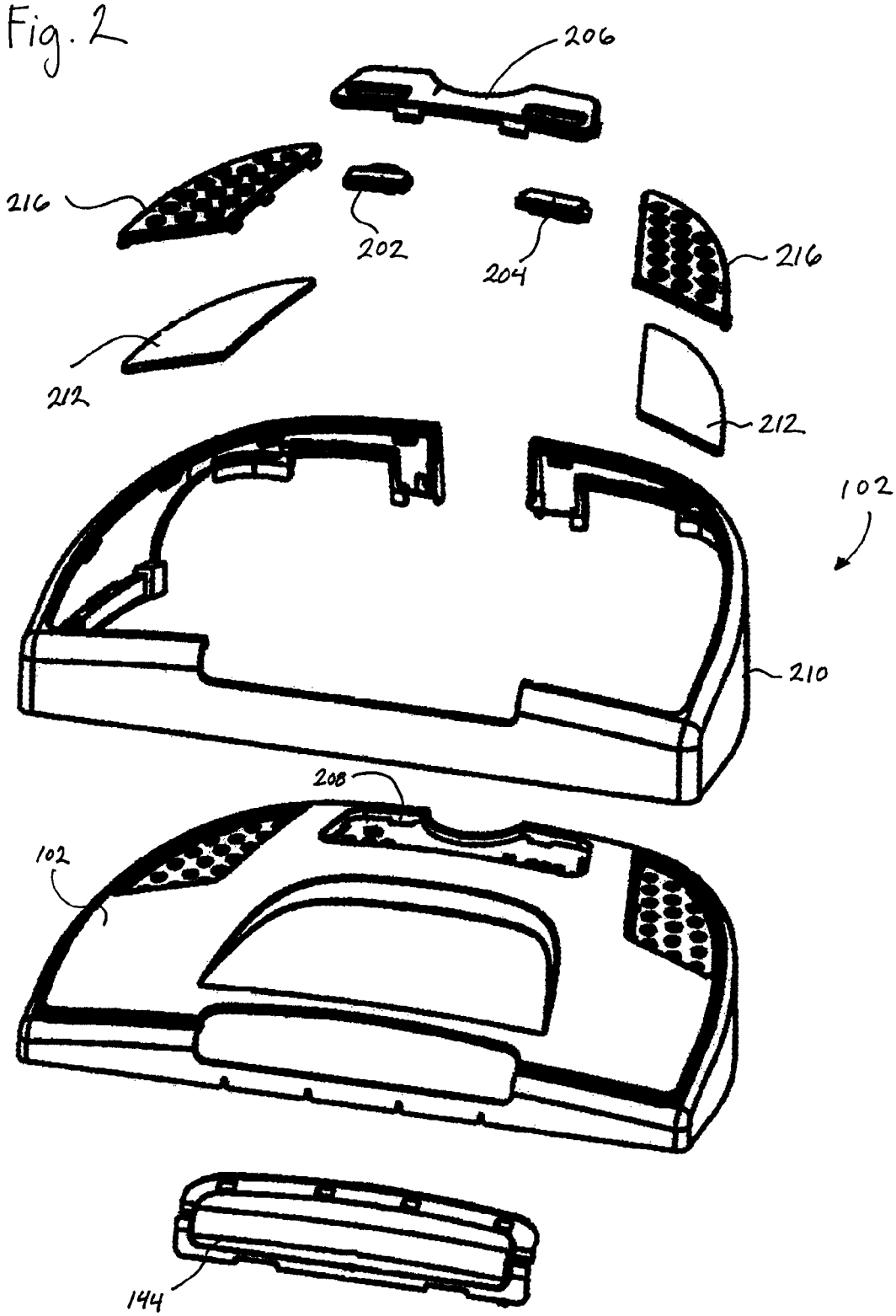
FIG. 2 is an exploded view of the top cover of the nozzle housing of FIG. 1A.

The nozzle housing 100 also may also have features to display other information to the user. For example, the nozzle housing 100 may have a brushroll status light 314 or a filter clog indicator, which may be viewable adjacent the height indicators 126, 128 and 130, or through a separate window 204, as shown in FIG. 2. The windows 202, 204 in the exemplary embodiment are captured in place by a clip 206 that holds them into a corresponding recess 208 in the upper surface of the top cover 102, but may be attached otherwise. The exemplary nozzle housing 100 also may include features such as a relatively soft and/or non-marking furniture guard 210, a headlight 142 and headlight cover 144, and one or more filters 212 to filter cooling air that passes over the brushroll motor 306. The filters 212 may comprise any kind, quality or performance grade filter. In the exemplary embodiment, the filters 212 are held in filter recesses 214 by filter covers 216, but other mounting arrangements are possible.

Figure 4A:
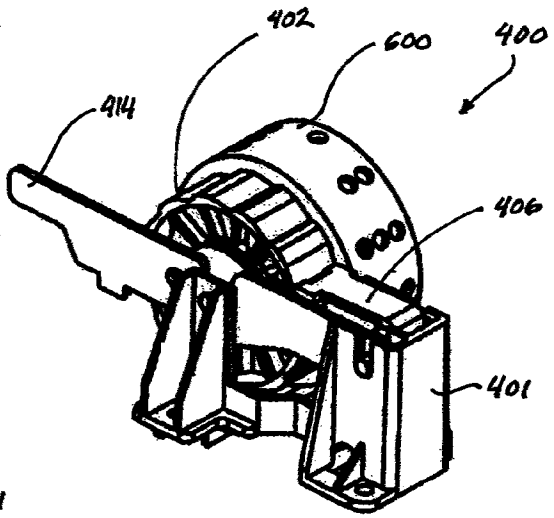
FIG. 4A is a perspective view of a carriage height adjustment cam assembly and blocking member according to an exemplary embodiment of the present invention.
Figure 4B:
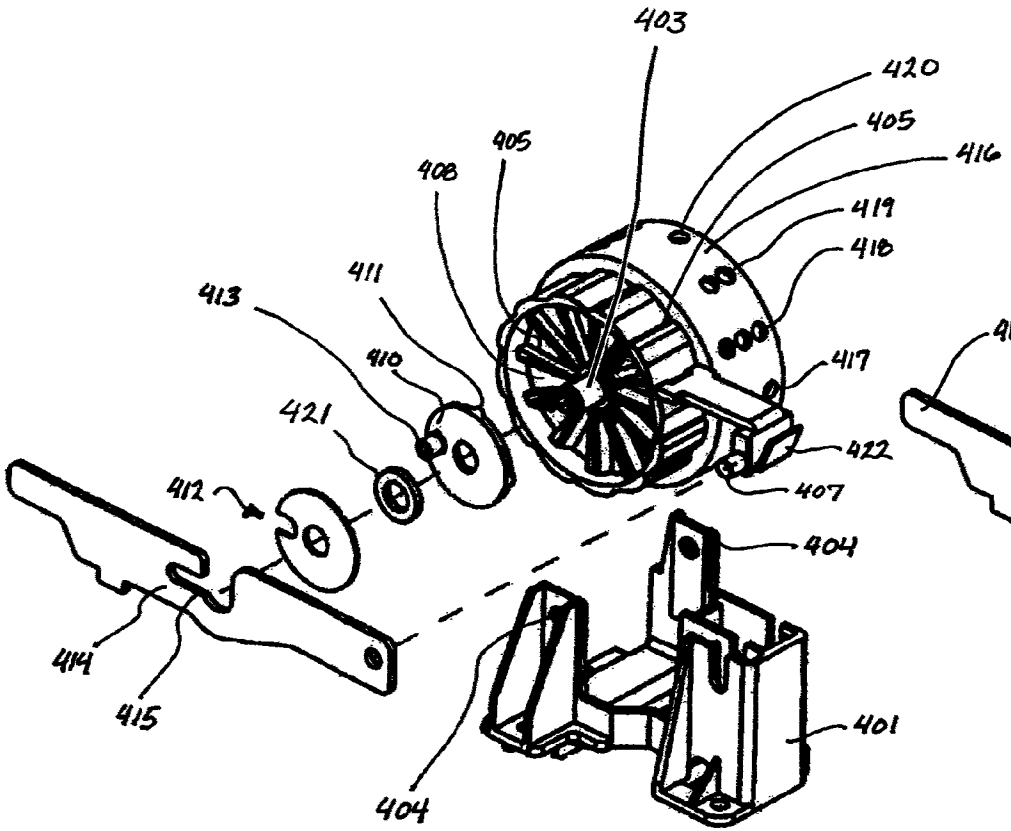
FIG. 4B is an exploded view of the device shown in FIG. 4A.
Figure 5:
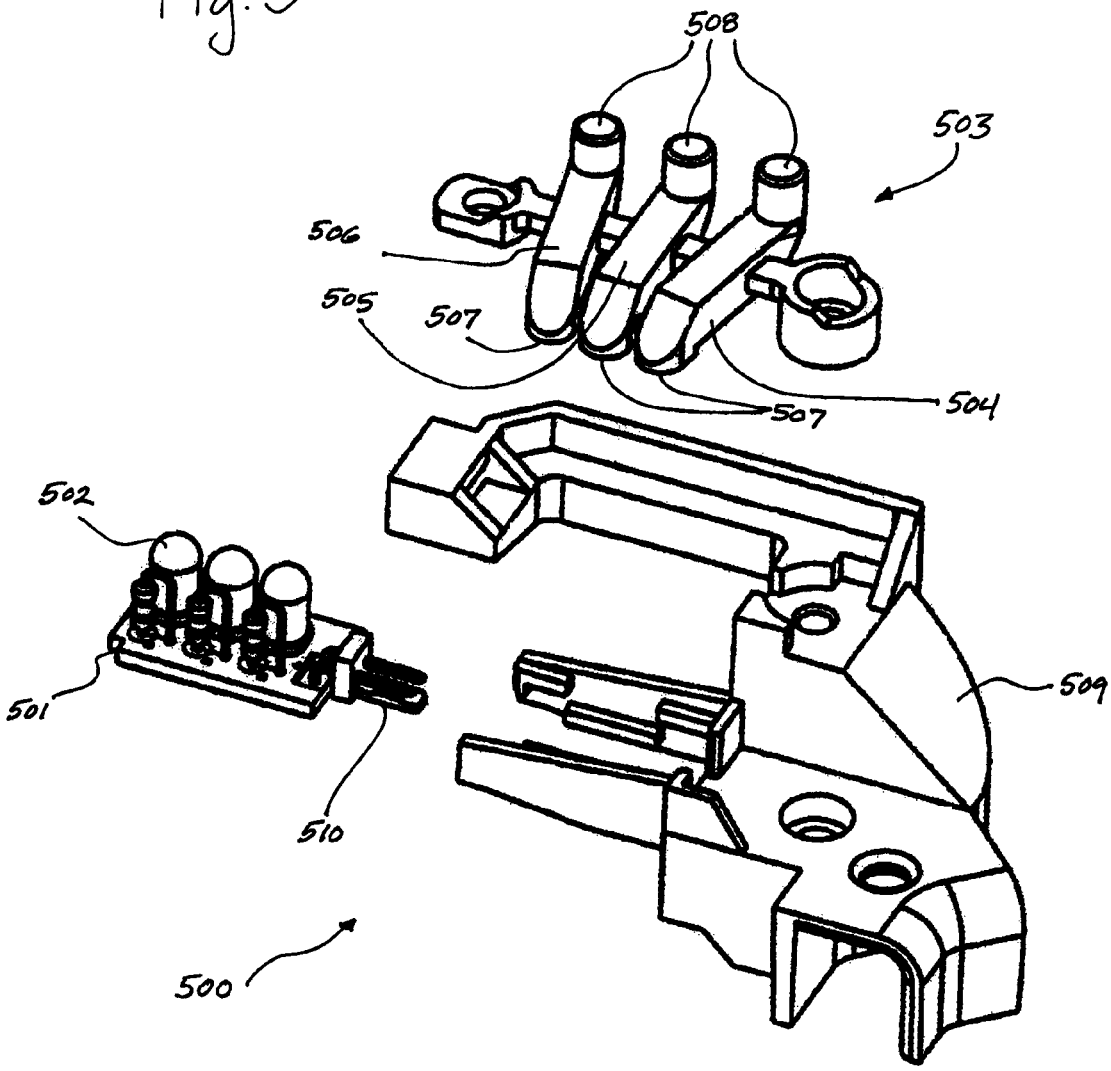
FIG. 5 is a perspective view of a light source and optical light guide according to an exemplary embodiment of the present invention.

Referring to FIGS. 4A, 4B and 6, the exemplary carriage height adjustment assembly 400 is mounted to the nozzle housing 100 and adapted to move the carriage assembly 110. In the exemplary embodiment, the height adjustment assembly 400 may be mounted by a subhousing 401 or directly to the base frame 104. The subhousing 401 may be fastened to the base frame 104 using screws or snaps to hold it securely in place, or by other devices. The height adjustment mechanism 400 includes a height adjustment cam 610, such as the one shown in the alternative exemplary embodiment of FIG. 6, that is fixed for rotation with a ratchet wheel 402. The ratchet wheel 402 and cam 610 are mounted for rotation on a shaft 403, which is mounted in opposite support portions 404 of the subhousing 401. The cam 610 includes four similarly-shaped lobes 611, 612, 613, and 614 that are spaced evenly apart about the axis of shaft 403. The lobes 611, 612, 613, 614 abut the carriage assembly lever arm 140, and as the cam 610 rotates, they cause a sequential movement of the carriage assembly 110 between the lowest position (i.e., in which the wheels 108 are closest to the nozzle housing 100) and the maximum elevated position (i.e., in which the wheels 108 are furthest from the nozzle housing 100).

The ratchet wheel 402 has a plurality of peripheral notches 405 that are selectively engaged by a tooth member 406. The tooth member 406 may be a resilient part that has a pivot 407 and return spring 422 formed integrally therewith, or it may be an assembly of parts. In the exemplary embodiment, the tooth member 406 is biased to a position in which it can engage the peripheral notches to hold the ratchet wheel 402 against rotation in one direction, but allow rotation in the opposite direction. Thus, the peripheral notches 405 and the tooth member 406 act generally as ratchet and pawl system. This arrangement may be modified in other embodiments, and similar devices may be used instead.

The ratchet wheel 402 also has face portion 408 having a plurality of axially projecting teeth 409 extending away from the axis of the shaft 403 and being spaced radially about the axis. An advancing wheel 410 is rotatably mounted on the shaft 403 and is provided with teeth 411 selectively engageable with the teeth 409 of ratchet wheel 402. The advancing wheel 410 is biased toward the face portion 408 by a spring, a compressible foam washer 421 or other resilient device. A low friction washer 412 is disposed outwardly of the advancing wheel 410 and is facially engaged with the side of an operating lever 414. The advancing wheel 410 is provided with a cylindrical projection 413 that extends through a recess in the operating lever 414 and a complementary recess in the low friction washer 412. The operating lever 414 may be mounted to the subhousing 401 or the nozzle housing 100 by a pivot, which may be the pivot 407 that mounts the tooth member 406, as shown. The other end of the operating lever 414 is connected to a foot pedal 146 that extends from the rear of the nozzle housing 100. The operating lever 414 is biased upwards by a spring 316 acting on a bottom surface of the lever 414. As the operating lever is 414 depressed, the recesses 415 and 412 cooperatively define an opening receiving the cylindrical projection 413 for movement with the lever 414.

In operation, the user depresses the foot pedal 126 to press the operating lever 414 downward. The operating lever 414 engages the cylindrical projection 413, and urges it downwards. This movement rotates the advancing wheel 410, and causes the advancing wheel teeth 411 to engage the ratchet wheel teeth 409 and rotate the ratchet wheel 402 and cam 610 one step. When the foot pedal 126 is released, the spring 316 presses is back up, and the slot 415 presses up on the cylindrical projection 413 to rotate the advancing wheel 410 back to its original position. During this return movement, the advancing wheel teeth 411 disengage from the ratchet wheel teeth 409 by virtue of the teeth 411, 409 being provided with ramp surfaces that press them apart during reverse rotation. The washer 421 or other spring advancing wheel 410 allows the advancing wheel 410 to move away from the ratchet wheel 402 during such movement.

At the end of each step, the ratchet wheel 402 is rotated a sufficient distance to position a successive peripheral notch 405 to receive the tooth member 406, which holds the ratchet wheel 402 in place. As the ratchet wheel 402 turns, so does the cam 610, and with each rotational step, the cam 610 holds the lever arm 140 a predetermined distance from the center axis of the cam 610. As the cam 610 rotates it repositions the lever arm 140, and this movement pivots the carriage assembly 110 about its crosspiece 132 to move the wheels 108 farther or closer to the nozzle housing 100. This movement lifts and lowers the brushroll 302 to different elevated positions above the surface being cleaned. The number and height of these positions depend on the shape of the cam 610 and the amount of rotation provided by each step, as known in the art.

Still referring to FIG. 4, a blocking member may be attached to the ratchet wheel 402 and fixed for rotation therewith. Alternatively, the blocking member may be driven by the lever 414, the pedal 146, or otherwise simultaneously operated with the ratchet wheel 402. In the illustrated exemplary embodiment, the blocking member comprises a cylindrical wall 416 having a plurality of holes 417, arranged in circumferential rows around the blocking member. The rows of holes 417 are further arranged such that at a first circumferential position 418 there are three holes arranged in an axial row, at a second circumferential position 419 there are two holes arranged in an axial row, and at a third circumferential position 420 there is a single hole. The circumferential positions 418, 419, and 420 are spaced and repeated around the circumference of the cylindrical wall 416 to correspond with the spacing of the different height positions provided on the cam 610. For example, as shown in FIG. 6, the cam 610 has four separate cam lobes 611, 612, 613, and 614, and each cam lobe has three height positions: a lowered position, a middle position, and a raised position. Each time the pedal 107 is depressed, the cam 610 rotates one step to the next height position. The pedal 107 must be depressed a total of twelve times to rotate the cam 610 through a full revolution (30 degrees per step), during which time the nozzle housing 100 will be raised and lowered four times. Similarly, the pattern of circumferential positions 418, 419, and 420 repeats around the blocking member a total of four times, and are evenly spaced at 30 degree intervals so that each time the pedal 107 is depressed, the circumferential positions 418, 419, and 420 advance by one step. The purpose and function of the blocking member and the holes 417 are explained subsequently herein.

A lighting assembly 500 may be mounted within the cylindrical wall 416 of the blocking member. The lighting assembly 500 may comprise one or more light sources 501, each of which may comprise any suitable source of light, such as one or more light-emitting diodes (LEDs) 502, incandescent or fluorescent light bulbs, and so on. The light source(s) may be any visible light source having any wavelength or combination of wavelengths. The light source also may be invisible to the human eye and used in conjunction with a filter or a other surface or material that renders the light visible. The light source 501 also may comprise a remote light source that is conveyed to the shown location by way of fiber optics or light guides.

In an exemplary embodiment, the light source 501 comprises multiple lights, such as commercially available LEDs 502 of any color. The LEDs 502 are mounted to a light source housing 509 that attaches to the base frame 104 to hold the LEDs 502 within the perimeter of the blocking member's cylindrical wall 416. The number of LEDs 502 equals the number of circumferential rows of holes 417 on the blocking member, but this is not necessary of all embodiments. Electrical leads 510 are provided to power the light source 501 from the vacuum cleaner's main power source or from an auxiliary power source, such as a battery. In the exemplary embodiment of FIG. 3, the light source 501 is powered by an electrical module 318 mounted in the nozzle housing 100 by a clip 320. This electrical module 318 may also control the operation of the brushroll motor, a motor status light, and other features, as known in the art. The light source 501, such as all three LEDs 502, may be illuminated simultaneously, and may be continuously illuminated during use. In addition, the light source 501 may instead be operated intermittently, such as only when the brushroll 302 is being driven. The LEDs 502 may also be provided with override functions, such as to flash or change colors when the brushroll motor 306 stops operating, or when a fault condition occurs. Other variations will be apparent to those of ordinary skill in the art in view of the present disclosure.

An optical light guide 503 may be provided within the nozzle housing 100 between the light source 501 and the blocking member's cylindrical wall 516, and/or between the blocking member's cylindrical wall 416 and the height display 124. The optical light guide 503 comprises a light-transmitting structure that may be formed as multiple assembled parts or as a one-piece part. Plastic injection-molding is an exemplary method for making a light guide 503. In the shown exemplary embodiment, the light guide 503 has three optically separate light paths 504, 505, and 506 that are commonly-formed as a single part that is affixed to the light source housing 509. Each of the light paths 504, 505, and 506 has an entry face 507 and an exit face 508, and each entry face 507 is aligned above a respective LED 502. Alternatively, separate light guides may be provided for each LED. Each light path 504, 505, and 506 transmits light striking its entry face 507 to its respective exit face 508 by refraction and/or reflection within the material, as known in the optical arts. Various polycarbonate and thermoplastic materials may be used to form the light guide 503, and the light guide 503 may be further treated with light-reflecting coatings and the like. Examples of such light guides are described, for example, in U.S. Pat. No. 5,467,501 and U.S. Patent Publication No. 2006/0075668, which are incorporated herein by reference.

The light guide is mounted with the entry faces 507 positioned generally above a respective LED 502, and the exit faces 508 positioned generally below a respective height indicator 126, 128, and 130 on the height display 124. The cylindrical wall 416 of the blocking member is positioned between the LEDs 502 and the entry faces 507 of the light paths 504, 505, and 506, and each circumferential row of holes 417 is aligned with a respective LED 502. In this configuration, the blocking member can be rotated to its different circumferential positions 418, 419, and 420, in which the holes 417 cover or expose one or more of the LEDs 502. When one or more holes 417 are aligned with one or more the LEDs 502, the holes 417 allow the light source 501 to transmit light to the exposed light guide entry faces 507. The light guide 503 conveys the light to the respective height indicators 126, 128, or 130, thereby providing an illuminated visual indication of the brushroll height position. As the user cycles the height adjustment mechanism through each step, the blocking member is also moved to align the appropriate number of holes 417 with the appropriate number of LEDs 502 to indicate the brushroll 302 height.

The foregoing describes one exemplary embodiment of the invention, in which a rotating, cylindrical blocking member having multiple holes though it is used to selectively cover or expose a light source to height indicators. As will be appreciated by those of ordinary skill in the art in view of the present disclosure, this embodiment may be modified in a number of ways.

In one example of an alternative embodiment, the holes may be replaced by a stepped or curved profile, as shown in FIG. 6. In this variation, the blocking member 600 comprises a cylindrical wall 601 that has a pattern of different axial widths at different circumferential positions 602, 603, and 604 corresponding to the steps provided by the height adjustment mechanism. These different axial widths provide openings through the blocking member 600 similarly to how the holes 417 in the embodiment of FIG. 4 provide openings through the blocking member. The differing axial widths can be continuously formed, or formed as discrete slots. In the shown embodiment of this variation, the light source 501 has three LEDs 502. When the first circumferential position 602 of the wall 601 is positioned between the blocking member 600 and the light guide (not shown), two of the LEDs 502 are covered, and one LED 502 is unblocked and able to transmit light to the light guide and height display 124. When the second circumferential position 603 is positioned between the blocking member 600 and the light guide, one LED 502 is covered, and two LEDs 502 are unblocked and able to transmit light to the light guide and height display 124. Finally, when the third circumferential position 604 is positioned between the blocking member 600 and the light guide, none of the LEDs 502 are covered, and all of them can transmit light to the light guide and height display 124. In this embodiment, at least one LED 502 is always illuminating a height indicator, but it may also be desirable to provide a blocking member that blocks light to all of the height displays to illustrate, for example, when the brushroll is lifted completely out of contact with the surface being cleaned.

While the cylindrical walls 416, 601 in the foregoing embodiments are shown as being continuous and able to rotate about 360 degrees, it will be understood that they may be provided as cylindrical walls that are not continuous, or that can not rotate about 360 degrees. For example a generally cylindrical wall of the foregoing embodiments may comprise a partial cylinder that is reciprocated about its axis as the height adjustment mechanism operates.

Figure 7:
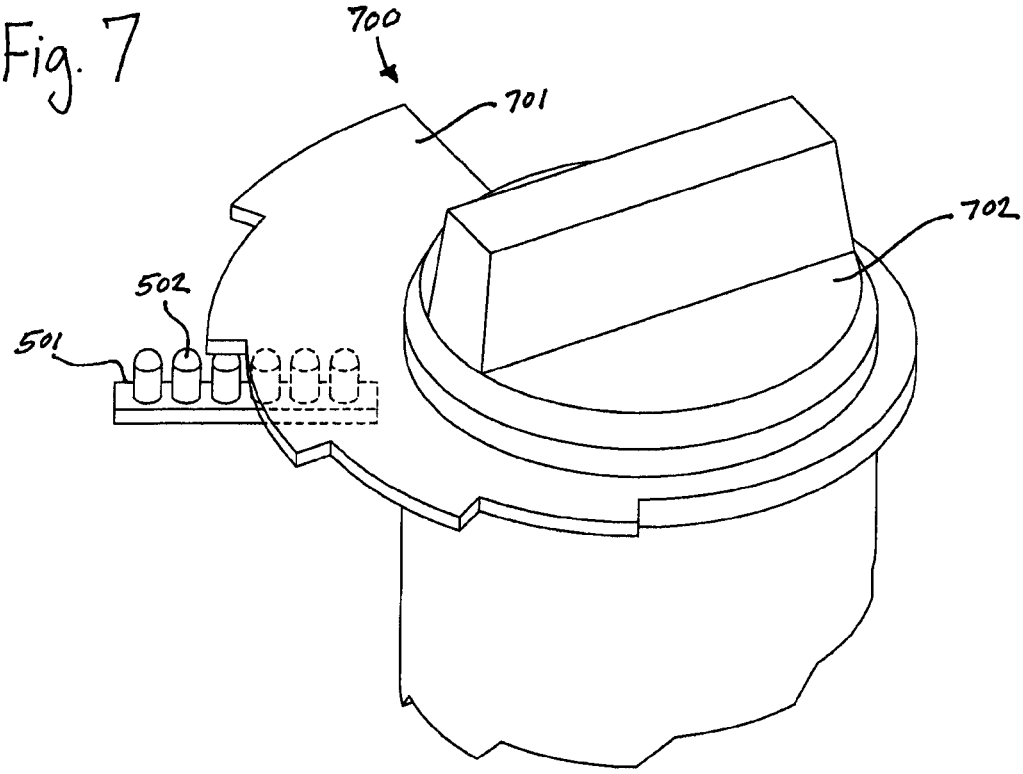
FIG. 7 is a perspective view of another alternative exemplary embodiment of a blocking member and carriage height adjustment mechanism.

In another embodiment, shown in FIG. 7, the blocking member 700 may comprise a radial skirt 701 having a stepped radius (or holes or slots) that blocks or exposes the light source 501 as the blocking member 700 is rotated. In this embodiment, the height adjustment mechanism comprises a cylindrical cam 702 that presses down on the wheel carriage (not shown) to hold it at various heights above the surface being cleaned. An example of such a device is shown in U.S. Pat. No. 5,774,932, which is incorporated herein by reference.

Figure 8:
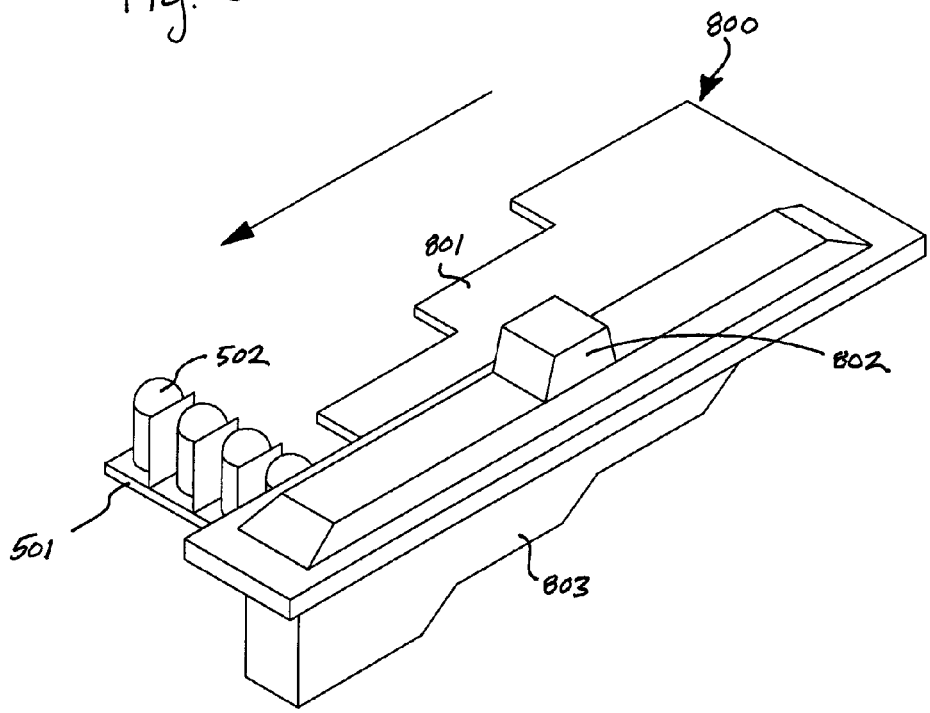
FIG. 8 is a perspective view of another alternative exemplary embodiment of a blocking member and carriage height adjustment mechanism.

In still another embodiment, shown in FIG. 8, the present invention is adapted to work in conjunction with a linear cam-type height adjustment mechanism. In this embodiment, the height adjustment is provided by moving a linear cam 803 laterally along a slot in the nozzle housing (not shown). Here, the blocking member 800 comprises a flat extension 801 that protrudes three distinct distances from the side of the cam 802. As the cam 802 is moved in a linear direction, as shown by the arrow, the extension 801 selectively covers portions of the light source 501 to provide an illuminated height display.

In any of the foregoing three embodiments, the blocking member may be modified by replacing the distinct "steps" with a gradual transition. this may be beneficial, for example, to provide partial lighting between or at distinct height adjustment positions. For example, the embodiment of FIG. 8 may be modified such that the flat extension 801 that forms the blocking member 800 comprises a straight, angled edge, rather than the shown stepped edge, and the cam 803 may comprise more than four steps. In such an embodiment, the cam can be moved to a height position at which the blocking member 800 only partially covers the light source 501 or a specific LED 502. Here, the light transmitted to a corresponding height indicator may be dimmer, but still visible. Other variations, such as using smaller or larger holes in the embodiment of FIG. 4, are also envisioned and included herein. These and other variations will be apparent to persons of ordinary skill in the art in view of the present disclosure.

While the foregoing embodiments illustrate the blocking member being attached directly to or formed as part of the height adjustment mechanism, this is not required. In other embodiments, the blocking member may be provided as a part that is separate from the height adjustment mechanism, but that is adapted to move in conjunction with the height adjustment mechanism. For example the blocking member may comprises a sliding or rotating member that is moved by a cam or gears on the height adjustment mechanism. The blocking member may also be located remotely from the height adjustment mechanism, such as by mounting it in an upright vacuum rear housing, or the remote grip of a canister or central vacuum powerhead. In such a case, cables, electric solenoids, or other mechanisms may be used to operate the blocking member.

Figure 9:
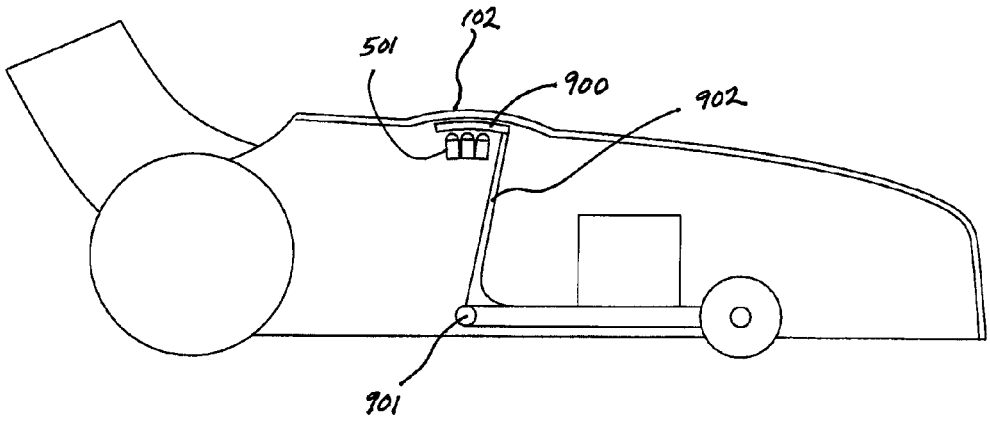
FIG. 9 is a schematic side view of an alternative exemplary embodiment of a blocking member.

In still other embodiments, the blocking member may be operated by movement of the wheel carriage or wheels (or other height adjustment mechanism parts) rather than being operated specifically by the height adjustment cam. For example, the blocking member may be moved by an arm extending from the wheel carriage, or may simply comprise an extension of the wheel carriage. An example of this latter embodiment is shown in FIG. 9, which illustrates a side view of a nozzle housing 100. Here, the a wheel carriage 111 is pivotally attached to the nozzle housing 100 at a pivot 901, and a height adjustment mechanism is provided to raise and lower the wheel carriage 111. An arm 902 extends from the wheel carriage 111 and includes a blocking member 900 that is interposed generally between a light source 501 and a height display 124. As the height is adjusted, the light source 501 can illuminate more of the height displays 102. Variations on such embodiments will be apparent to those of ordinary skill in the art in view of the present teachings.

Another variation on the invention is to eliminate the light guide or guides. In this embodiment, the light source may be positioned relatively close to the height displays, and the blocking member is selectively positioned between the light source and the height displays to control which displays are illuminated. The light guide(s) also may be integrated into or consolidated with the height display, such as by locating the exit face(s) of the light guide(s) in an opening through the nozzle housing for direct viewing by the user. Where flexible fiber optics are used, the height display may also be located remotely from the nozzle housing, such as by positioning it in the hand grip of a canister or central vacuum wand or at the top of an upright vacuum hear housing.

While the embodiments of the invention described above are preferred, it will be recognized and understood that these embodiments are not intended to limit the invention, which is limited only by the appended claims. Various modifications may be made to these embodiments without departing from the spirit of the invention and the scope of the claims. For example, those skilled in the art will appreciate that other variations of the blocking member, light source, height display and/or light guide can be used with the present invention. These and other modifications are included within the scope of the appended claims.

What is claimed is:

1. A nozzle height indicator for a vacuum cleaner, the nozzle height indicator comprising:

a height display adapted to be viewed by a user;

a light source adapted to emit light; and a blocking member comprising a generally cylindrical surface adapted to rotate about an axis thereof, wherein the generally cylindrical surface is adapted to be positioned in a first position in which it allows the light to illuminate the height display and a second position in which it substantially prevents the light from illuminating at least a portion of the height display.

2. The nozzle height indicator of claim 1, wherein the generally cylindrical surface comprises a plurality of openings passing through the generally cylindrical surface and arranged in rows around the circumference of the generally cylindrical surface.

3. The nozzle height indicator of claim 1, further comprising a light guide located between the blocking member and the height display, the light guide being adapted to transmit the light from the light source to the height display.

4. The nozzle height indicator of claim 1, wherein the height display comprises a plurality of height position indicators, and the blocking member is adapted to selectively illuminate one or more of the height position indicators.

5. The nozzle height indicator of claim 4, further comprising a light guide located between the blocking member and the height display, the light guide comprising a plurality of guiding paths, each guiding path being adapted to transmit the light from the light source to at least one of the height position indicators.

6. The nozzle height indicator of claim 1, wherein the light source comprises a plurality of lights.

7. The nozzle height indicator of claim 4, wherein the light source comprises a plurality of lights, each light corresponding to a respective height position indicator.

8. A nozzle height indicator for a vacuum cleaner, the nozzle height indicator comprising:

a height display comprising a plurality of height indicators;

a light source adapted to emit light; and a blocking member comprising a surface adapted to reciprocate in a linear direction, the surface being adapted to be positioned in a plurality of positions to selectively allow the light from the light source to illuminate one or more of the light indicators, thereby indicating the height of an associated vacuum cleaner inlet nozzle relative to a surface being cleaned.

9. The nozzle height indicator of claim 8, wherein the blocking member comprises a surface adapted to rotate about an axis.

10. The nozzle height indicator of claim 8, further comprising a light guide located between the blocking member and the height display, the light guide being adapted to transmit the light from the light source to the height display.

11. The nozzle height indicator of claim 8, wherein the light source comprises a plurality of lights.

12. A vacuum cleaner inlet nozzle, comprising:

a nozzle housing;

an inlet positioned on the lower face of the nozzle housing and adapted to face a surface to be cleaned;

a carriage moveably attached to the nozzle housing, wherein movement of the carriage adjusts the distance between the inlet and the surface to be cleaned;

a carriage height adjuster adapted to selectively position at least a portion of the carriage at two or more predetermined distances from the lower face of the nozzle housing;

a height display adapted to be viewed by a user;

at least one light source adapted to emit light; and a blocking member comprising a generally cylindrical surface adapted to rotate about an axis thereof, wherein the generally cylindrical surface is adapted to be positioned in a first position in which it allows light from the light source to illuminate the height display and a second position in which it substantially prevents light from the light source from illuminating at least a portion of the height display, wherein the height display shows the position of the carriage relative to the lower face of the nozzle housing.

13. The vacuum cleaner inlet nozzle of claim 12, wherein the carriage height adjuster comprises a cam adapted to press on the carriage.

14. The vacuum cleaner inlet nozzle of claim 13, further comprising a foot pedal adapted to move the cam.

15. The vacuum cleaner inlet nozzle of claim 12, wherein the generally cylindrical surface comprises a plurality of openings passing through the generally cylindrical surface and arranged in rows around the circumference of the generally cylindrical surface.

16. The vacuum cleaner inlet nozzle of claim 12, further comprising a light guide located between the blocking member and the height display, the light guide being adapted to transmit the light from the light source to the height display.

* * * * *